United States Patent [19]

Blaschke et al.

[11] 4,441,749

[45] Apr. 10, 1984

[54] ELEVATOR FOR CASING

[75] Inventors: Kurt Blaschke, Saarbrücken-Dudweiler; Josef Roob, St. Wendel, both of Fed. Rep. of Germany

[73] Assignee: Stahl- und Apparatebau Hans Leffer GmbH, Saarbruecken-Dudweiler, Fed. Rep. of Germany

[21] Appl. No.: 291,943

[22] Filed: Aug. 11, 1981

[30] Foreign Application Priority Data

Aug. 16, 1980 [DE] Fed. Rep. of Germany ..... 3031027

[51] Int. Cl.[3] ..... B66C 1/42; E21B 19/02

[52] U.S. Cl. ..... 294/88; 294/90

[58] Field of Search ..... 294/88, 90, 102 R, 102 A, 294/106, 110 R, 110 A; 414/626, 22, 745, 730, 739, 783; 24/263 R, 263 DA; 254/333

[56] References Cited

U.S. PATENT DOCUMENTS 2,695,189 11/1954 Chrisman et al. ..... 294/90

FOREIGN PATENT DOCUMENTS 1359322 3/1964 France ..... 294/88

*Primary Examiner*—James B. Marbert

*Attorney, Agent, or Firm*—Schwartz, Jeffery, Schwaab, Mack, Blumenthal & Koch

[57] ABSTRACT

An elevator for casing pullers with elevator links adapted for motorized opening and for the lateral approach to a casing which is to be pulled. One of the elevator links is constructed as a hook, into which a locking bolt of a power jack can be pivoted, which said power jack is copivotingly secured on the second movable elevator link and closes the elevator by retraction of the locking bolt.

7 Claims, 2 Drawing Figures

ELEVATOR FOR CASING

BACKGROUND OF THE INVENTION

The invention relates to an elevator for gripping, by frictional engagement, casings for pile foundations, for example for casing pullers, with pivotably supported elevator links. The links can be opened by a motor drive through pressure-medium operated power jacks and can be locked to each other in tension with a power jack for applying the closing force.

With elevators of this kind it is possible for the associated casing puller or casing machine to be brought into a working position by sliding transversely to the borehole while the elevator links are spread open and the base frame is correspondingly open. An elevator of the kind described hereinbefore is disclosed in the German Offenlegungsschrift No. 25 15 467 which is adapted to the task of gripping a casing, situated close to a wall, by means of pivotable elevator links. To this end, a controlled cylinder is provided to assist the operation of interlocking adjoining, openable elevator links, but the said cylinder does not participate in applying the closing force. A separate tensioning cylinder, adapted to act between the non-openable elevator links, is provided to this end. The German Offenlegungsschrift No. 27 08 727 and the U.S. Pat. No. 2,684,166, relating to an elevator for soil drilling casings are part of the extended prior art.

SUMMARY OF THE INVENTION

It is the object of the invention to eliminate all manual work from the entire locking and unlocking operation in the region of the joint between adjoining, openable elevator links of an elevator of the kind hereinbefore described, while simplifying the construction of the elevator itself. According to the invention, this problem is solved in that the first elevator link, which can be pivoted by a motor drive independently of the second elevator link is constructed as a hook which is open to the outside, and that the second elevator link is connected double-acting force which is secured to pivot with the second elevator link. The force jack includes a part which is movable with respect to the elevator link, is associated with a locking bolt, adapted to fit the hook. The locking bolt can be pivoted by the pivoting motion into the hook opening of the first elevator link, previously pivoted into the closing position, and the power jack can be actuated to pull the locking bolt into the hook. The power jack functions as the only tensioning jack for applying the closing force.

This ensures, that owing to the arrangement of the locking and tensioning cylinder which pivots with the second elevator link, the locking bolt can be automatically driven into the hook opening when the thrust elements, distributed in a circular arc and associated with the appropriate elevator link, bear upon the casing. Actuation of the power jack at this time not only results in the high tensile locking of adjacent elevator links but also the closing force of the elevator is applied using the single power jack as both a locking and a tensioning cylinder. Further, owing to its connection to the elevator element, the power jack retains its relative position to the elevator link after unlocking when the link is opened, so that renewed locking of the locking bolt at the end of the pivoting motion again finds the hook opening on the second elevator link. All motions, namely pivoting of the elevator links by means of known pivoting jacks, which are to be actuated independently of each other within the scope of the invention, and biassing of the single locking and tensioning jack in one or the other direction can be controlled from the control stand so that only one operator is required for actuating the elevator according to the invention.

BRIEF DESCRIPTION OF THE DRAWING

The various objects and advantages of the invention will be apparent in the following detailed description of the invention and are disclosed in claims 2 to 5 and are described hereinbelow by reference to the accompanying drawings in which:

DETAILED DESCRIPTION OF THE PREFERRED EMBODIMENT

Figure 1:
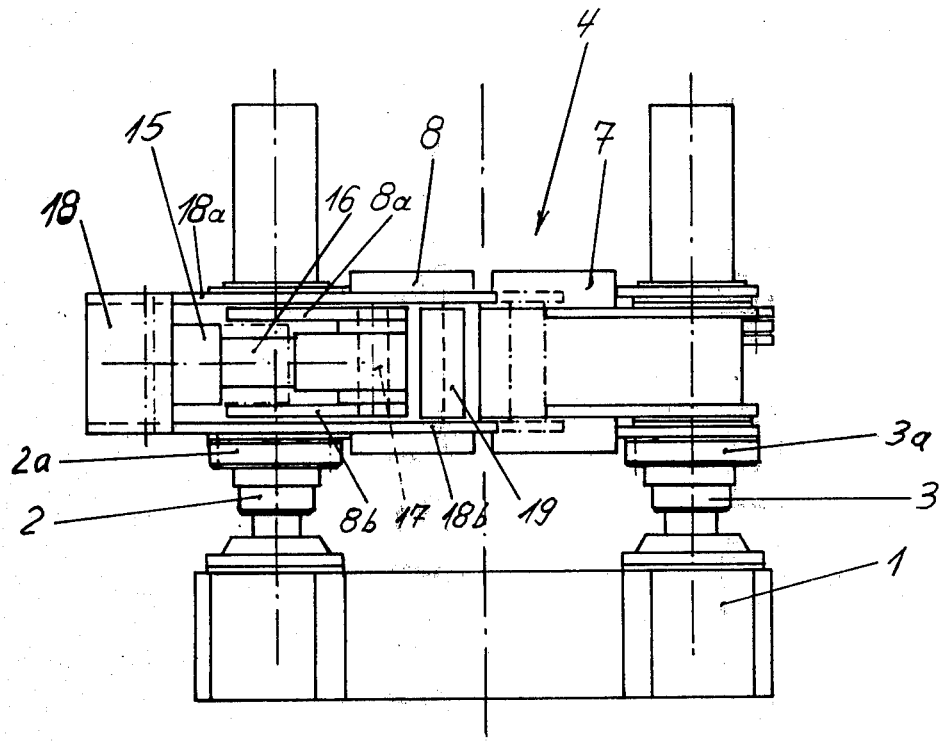
FIG. 1 is a side view of the casing puller towards the locking side with the elevator closed and FIG. 2 is a plan view of two elevator links, with the opened position shown in dash-dot lines.
Figure 2:
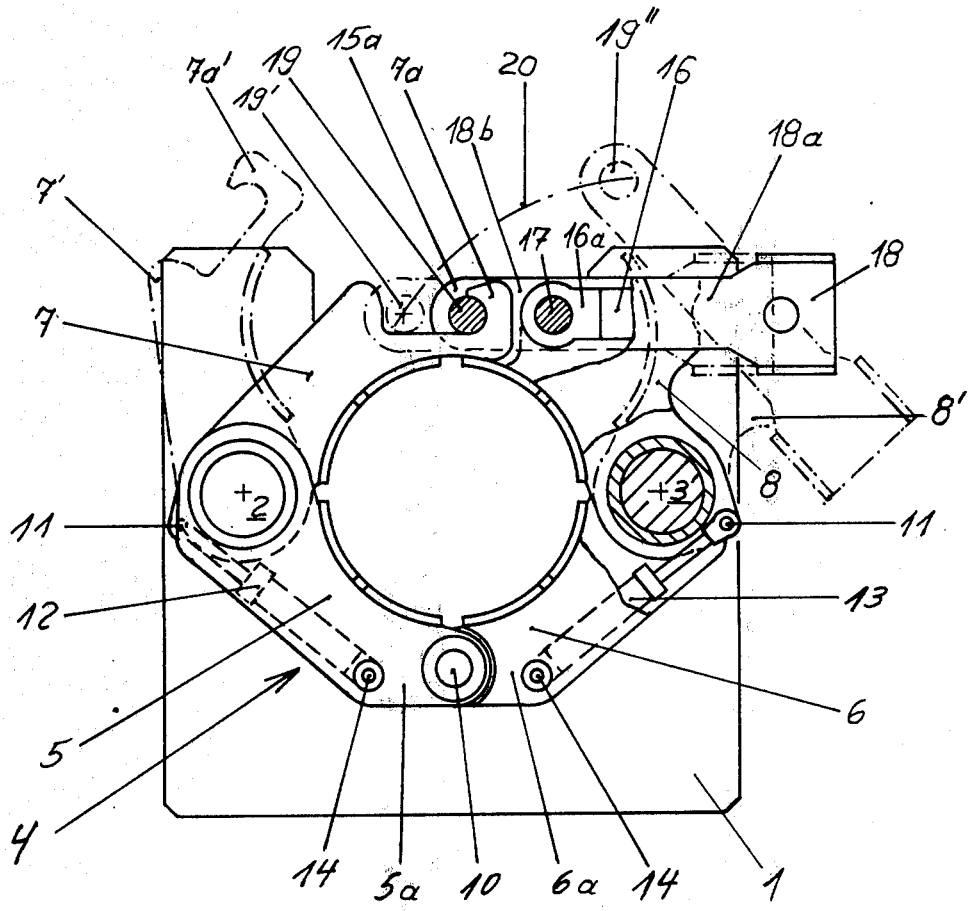

FIG. 1 discloses a base frame on which two jacks 2 and 3 bear, the collars 2*a* and 3*a* of which support the entire elevator 4. The elevator 4 comprises four elevator links 5, 6, 7 and 8 (FIG. 2) of which the elevator links 5, 6 are immovable and the elevator links 7, 8 can be spread open as indicated by 7' and 8' in broken lines in FIG. 2. The immovable elevator links 5, 6 are secured by means of their bores to the jacks 2 and 3 which extend through the said bores. The upper interlinking ends 5*a*, 6*a* thereof are joined by means of a common cross-pin 10.

The openable elevator links 7, 8 are pivotally supported by the jacks 2, 3 and in the region thereof are adapted to support bolts 11, to each of which there is connected one pivoting jack 12, 13. The pivoting jacks are reciprocatingly supported via bolts 14 by the elevator links 5, 6 in the manner already disclosed in the German Offenlegungsschrift No. 28 15 467.

The free end of the openable elevator link 7 is constructed as a hook 7*a*, which is open towards the outside, as can be seen most readily by reference to the opened position 7' shown in dash-dot lines at 7*a'*. The contours of the second openable elevator link 8 can also best be recognized by reference to the open position 8' and the said link is adapted to accommodate a power jack 15 in such a way that the said power jack coexecutes all motions of the elevator link 8 in unchanged relation thereto. As can be seen by reference to FIG. 2 and the side view of FIG. 1, the piston rod 16 of the power jack 15 is constructed to form an eye 16*a* on the locking side, the said eye surrounding a cross pin 17. The piston rod is secured by means of the said cross pin 17 on the sheet metal mouldings 8*a*, 8*b*, disposed at a distance from each other and associated with the elevator link 8.

The cylinder 15 is rectilinearly guided so as to be movable within the elevator link 8 in the direction in which the force is applied (not shown) and on the lid side bears on a head member 18 from which two tie lugs 18*a* and 18*b* emerge, which extend above or below the sheet metal mouldings 8*a*, 8*b* and whose bifurcated ends support a locking bolt. The movable arrangement of the cylinder in place of the piston rod offers the advantage that the larger thrust surface of the cylinder piston is biassed to apply the closing force.

Due to the pivoting motion of the elevator link 8 and with the cylinder 15 set to the left (FIG. 2), the locking bolt 19 is able to enter the opening of the hook 7*a* of the elevator link 7, which was previously distributed towards the casing, so that the locking bolt occupies the starting position 19'. The circular arc 20 indicates the pivoting path of the locking bolt 19. If the power jack 15 is actuated in the sense of closing the elevator and is set to the right (FIG. 2) the locking bolt will move from the position 19' into the operative position 19 and enter into a tension resisting connection with the hook 7*a*. If pressure is applied to the power jack 15, the two elevator elements 7, 8 will be pulled further towards each other to stress the casing, not shown, by frictional engagement against the immovable elevator elements 5 and 6. Unlocking by reversal of the power jack 15 causes the locking bolts to assume the position 19' and to return over the circular arc 20 into the position 19'' if the elevator link 8 is pivoted by the pivoting jack 13 into the open position 8', from which the locking bolt 19 again finds the opening of the hook 7*a*, i.e. it reaches the position 19', because the power jack is rectilinearly guided in the elevator link 8, namely approximately tangentially to the circumference of the casing to be gripped, when in the locked position.

What we claim is:

1. An elevator for gripping casings, comprising:

first and second pivotably supported elevator links;

means for producing independent powered pivot movements of said first and second elevator links between an open position in which said links are spaced from one another to form an opening in a side of said elevator to receive a casing laterally into said elevator, and a closed position for gripping a casing received in said elevator;

a double acting force jack secured to said second elevator link for pivotal movement therewith, said force jack being actuatable to produce rectilinear motion of a portion of said force jack;

a hook;

a locking bolt adapted to engage said hook;

one of said hook and locking bolt being attached to said first elevator link, and the other of said hook and locking bolt being connected to said portion of said force jack for rectilinear movement with said portion;

wherein said force jack supplies all of the tension on said first and second elevator links necessary to grip a casing.

2. An elevator as claimed in claim 1, wherein said locking bolt is connected to said power jack portion.

3. An elevator as claimed in claim 2, wherein said power jack comprises a cylinder and a piston rod, the piston rod of the power jack having one end nearest to the locking bolt, said one end being secured to a cross-pin extending through the second elevator link, said cylinder being movably guided by the second elevator link in the direction of force application and being connected to tie lugs between which the locking bolt extends.

4. An elevator as claimed in claim 1, wherein the two pivotable elevator links are supported by lifting jacks adapted to move the elevator with respect to a base frame.

5. An elevator as claimed in claim 4, wherein the lifting jacks extend through two additional elevator links, which cannot be opened, said additional elevator links having interlinking ends connected by a common cross pin.

6. An elevator as claimed in claim 4, wherein the elevator in its entirety is supported by collars associated with the lifting jacks.

7. An elevator as claimed in claim 5, wherein the elevator in its entirety is supported by collars assigned with the lifting jacks.

* * * * *